US008117881B2

(12) United States Patent
Mishima et al.

(10) Patent No.: US 8,117,881 B2
(45) Date of Patent: Feb. 21, 2012

(54) PRESS-MOLDING METHOD AND PRESS-MOLDING DEVICE

(75) Inventors: Keisuke Mishima, Tokyo (JP); Hirofumi Kuroda, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 710 days.

(21) Appl. No.: 11/887,379

(22) PCT Filed: Mar. 31, 2006

(86) PCT No.: PCT/JP2006/307381

§ 371 (c)(1),
(2), (4) Date: Dec. 11, 2008

(87) PCT Pub. No.: WO2006/104270

PCT Pub. Date: Oct. 5, 2006

(65) Prior Publication Data

US 2009/0107203 A1 Apr. 30, 2009

(30) Foreign Application Priority Data

Mar. 31, 2005 (JP) ..... 2005-101852

(51) Int. Cl.
*B23P 11/00* (2006.01)

(52) U.S. Cl. ..... 72/348; 72/82; 72/112; 72/115; 72/125; 72/370.13; 72/379.4; 72/419; 72/421

(58) Field of Classification Search ..... 72/80, 82, 72/112, 115, 125, 348, 370.12, 370.13, 379.4, 72/419, 420, 421
See application file for complete search history.

(56) References Cited

U.S. PATENT DOCUMENTS

| | | | | |
|---|---|---|---|---|
| 2,403,183 | A * | 7/1946 | Lefere | 72/348 |
| 2,980,993 | A * | 4/1961 | Lyon | 72/348 |
| 4,423,616 | A * | 1/1984 | Pease | 72/348 |
| 6,351,981 | B1 | 3/2002 | Jowitt et al. | |
| 6,742,236 | B1 | 6/2004 | Dion et al. | |
| 7,395,685 | B2 * | 7/2008 | Campo et al. | 72/348 |
| 7,775,077 | B2 * | 8/2010 | Mishima et al. | 72/125 |
| 7,854,156 | B2 * | 12/2010 | Tsuda et al. | 72/82 |
| 2002/0170334 | A1 * | 11/2002 | Zauhar | 72/348 |
| 2003/0154600 | A1 | 8/2003 | Umeda et al. | |

FOREIGN PATENT DOCUMENTS

| | | |
|---|---|---|
| JP | 2001-516643 | 10/2001 |
| JP | 2002-153930 | 5/2002 |
| JP | 2003-509181 | 3/2003 |
| JP | 2003-200241 | 7/2003 |
| JP | 2005-342725 | 12/2005 |

* cited by examiner

*Primary Examiner* — David Jones
(74) *Attorney, Agent, or Firm* — Rabin & Berdo, P.C.

(57) ABSTRACT

A press-molding device (80) press molds a bottom portion of a work piece (9) having a closed-end shape between an, inner die (521) inserted into the work piece (9) and an outer die (551) disposed on an outside of the work piece (9). A chuck position switching mechanism (501) grips the work piece (9) so that the work piece (9) can move in an axial direction. An inner die moving mechanism (522) inserts the inner die (521) into the inside end of the work piece (9). A stopper mechanism (531) supports the inner die (521) in a processing position by restricting movement of the inner die (521). An outer die moving mechanism (552) press-molds the bottom portion of the work piece (9) between the outer die (551) and the inner die (521), thereby press-molding the workpiece (9) smoothly without damaging an inner peripheral surface of the workpiece (9).

5 Claims, 6 Drawing Sheets

PRESS-MOLDING METHOD AND PRESS-MOLDING DEVICE

FIELD OF THE INVENTION

This invention relates to an improvement in a press-molding method and a press-molding device for press-molding the bottom portion of a work piece formed into a closed-end shape through implementation of a closing operation for closing an open end of a metal pipe material.

BACKGROUND OF THE INVENTION

In a closing method, a work piece constituted by a metal pipe material is rotated and a die is pressed against the work piece while the work piece is heated. Thus, the work piece undergoes plastic deformation as it gradually approaches the die, and as a result, an end portion of the work piece is formed into a closed bottom portion.

This closing method is disclosed in JP2002-153930.

The work piece formed into a closed-end shape through implementation of the closing operation is press-molded by a press-molding device. A conventional press-molding device comprises an inner die which is inserted into the inside end of the closed-end work piece, and an outer die disposed on the outside of the work piece. The inner die is driven by a hydraulic cylinder such that the bottom portion of the work piece is compressed between the inner die and the outer die.

In a conventional press-molding device, however, if the work piece moves when the inner die is inserted into the inside end of the work piece, the inner die may impinge on and damage the inner peripheral surface of the work piece.

To prevent this, the outer peripheral surface of the work piece may be gripped when the inner die is inserted into the inside end of the work piece so that the work piece does not move. However, when the outer peripheral surface of the work piece is gripped so that the work piece does not move, the work piece is unable to move in the axial direction thereof when the work piece is compressed between the inner die and outer die, and as a result, press-molding of the work piece cannot be performed smoothly.

Furthermore, a conventional press-molding device is structured such that the inner die is driven by a hydraulic cylinder and thereby inserted into the inside end of the work piece. As a result, the inner die cannot be moved quickly, leading to an increase in the tact time for press-molding a single work piece.

It is therefore an object of this invention to provide a press-molding method and a press-molding device for press-molding a work piece formed into a closed-end shape smoothly without damaging an inner peripheral surface of the work piece.

SUMMARY OF THE INVENTION

This invention provides a press-molding method for press-molding a bottom portion of a work piece having a closed-end shape between an inner die inserted into an inside end of the work piece and an outer die disposed on an outside of the work piece, comprising gripping the work piece via a core adjusting chuck mechanism so that the work piece can move in an axial direction thereof, moving the inner die in the axial direction via an inner die moving mechanism so that the inner die is inserted into the inside end of the work piece, restricting movement of the inner die via a stopper mechanism so that the inner die is supported in a processing position, and moving the outer die in the axial direction of the work piece via an outer die moving mechanism so that the bottom portion of the work piece is press-molded between the outer die and the inner die.

Further, this invention provides a press-molding device for press-molding a bottom portion of a work piece having a closed-end shape between an inner die inserted into an inside end of the work piece and an outer die disposed on an outside of the work piece, comprising a core adjusting chuck mechanism which grips the work piece so that the work piece can move in an axial direction thereof, an inner die moving mechanism which inserts the inner die into the inside end of the work piece by moving the inner die in the axial direction, a stopper mechanism which supports the inner die in a processing position by restricting movement of the inner die, and an outer die moving mechanism which press-molds the bottom portion of the work piece between the outer die and the inner die by moving the outer die in the axial direction.

According to this invention, during press-molding in which the work piece is compressed between the outer die and the inner die, the core adjusting chuck mechanism permits movement of the work piece in the axial direction thereof via rollers, and therefore, when the inner die moving mechanism moves the inner die to insert the inner die into the inside end of the work piece, the core adjusting chuck mechanism can grip the work piece, and the inner die can be prevented from impinging on the inner peripheral surface of the work piece and causing damage thereto.

When the outer die moving mechanism moves the outer die to push the work piece, the work piece moves in the axial direction relative to the core adjusting chuck mechanism, and the stopper mechanism restricts movement of the inner die such that the inner die is supported in the processing position. When the outer die pushes the work piece further, the work piece is compressed smoothly between the outer die and the inner die, and as a result the work piece is press-molded into a predetermined shape.

The inner die moving mechanism does not receive a load during press-molding, and therefore the inner die can be inserted into the inside end of the work piece via an air cylinder, for example. Hence, the inner die can be moved quickly, enabling a reduction in the tact time for press-molding a single work piece and an improvement in production efficiency.

BRIEF DESCRIPTION OF THE DRAWINGS

FIG. 5 is a sectional view of a core adjusting chuck mechanism and so on.

DESCRIPTION OF THE PREFERRED EMBODIMENTS

This invention will now be described in detail, in accordance with the attached drawings.

A press-molding device 80 shown in FIGS. 1 to 4 press-molds a bottom portion 9*c* of a work piece 9 that has undergone a closing operation.

A closing machine rotates the work piece 9, which is constituted by a metal pipe material, and presses a die against the work piece 9 while heating the work piece 9. As a tip end portion of the work piece 9 gradually approaches the die, the work piece 9 is subjected to plastic deformation, and as a result, the bottom portion is formed into a completely closed shape.

The work piece 9, which reaches a high temperature of 1000° C. or more following the closing operation performed by the closing machine, is cooled to approximately 100° C. by a cooling device not shown in the figure, and then conveyed to the press-molding device 80 and press-molded by the press-molding device 80.

In FIGS. 1 to 4, three axes, namely X, Y, and Z, are set orthogonal to each other. It is assumed that the X axis extends in a substantially horizontal lateral direction, the Y axis extends in a substantially horizontal front-rear direction, and the Z axis extends in a substantially vertical direction. The constitution of the press-molding device 80 will now be described.

Figure 3:
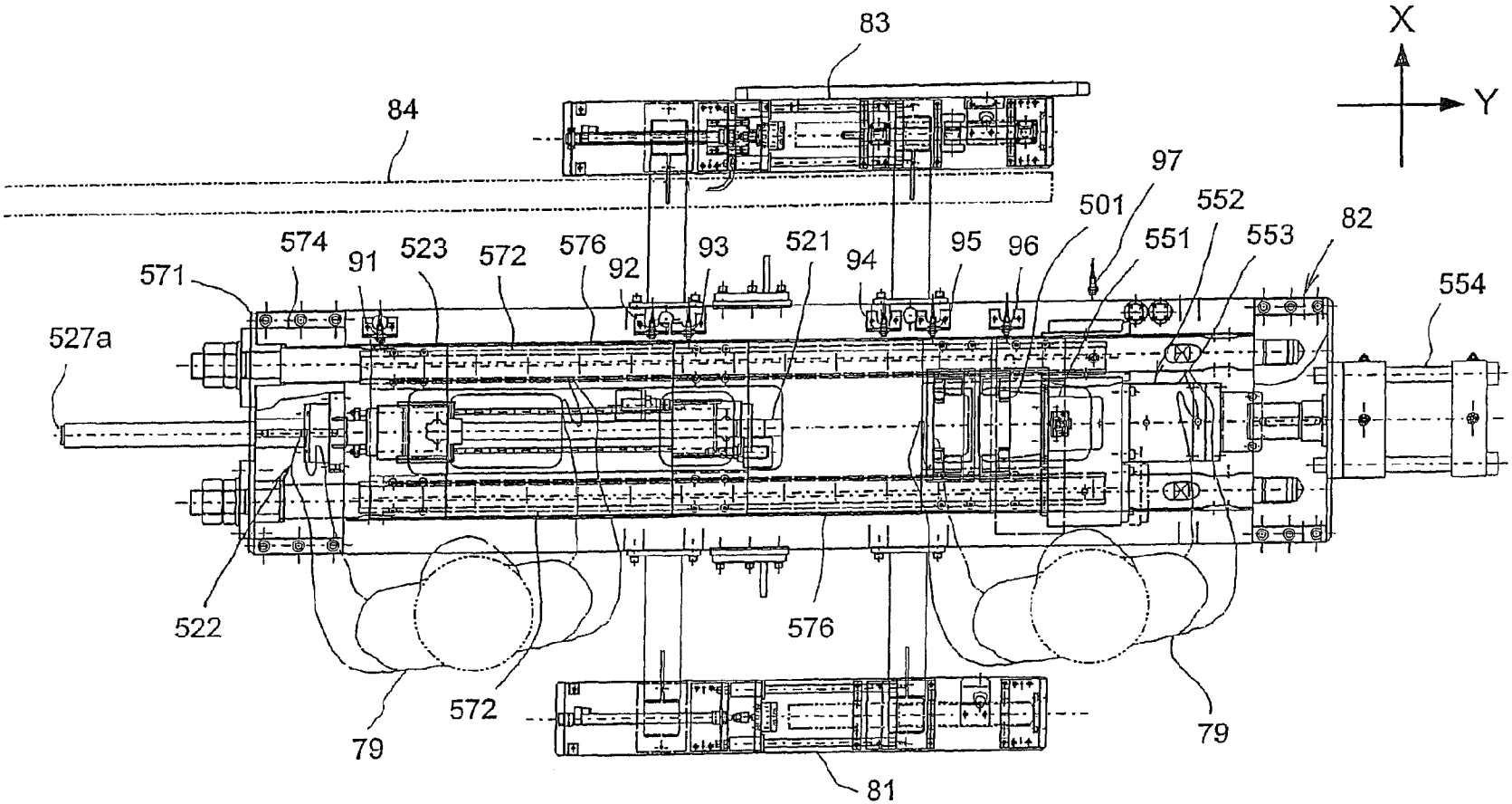
FIG. 3 is a plan view of the press-molding device.

In FIG. 3, the press-molding device 80 is provided with an introduction table 81, a press-molding machine 82, and a discharge table 83, which are arranged in series in the X axis direction. A chute 84 for discharging defective work pieces 9 is provided in series with the discharge table 83.

Figure 1:
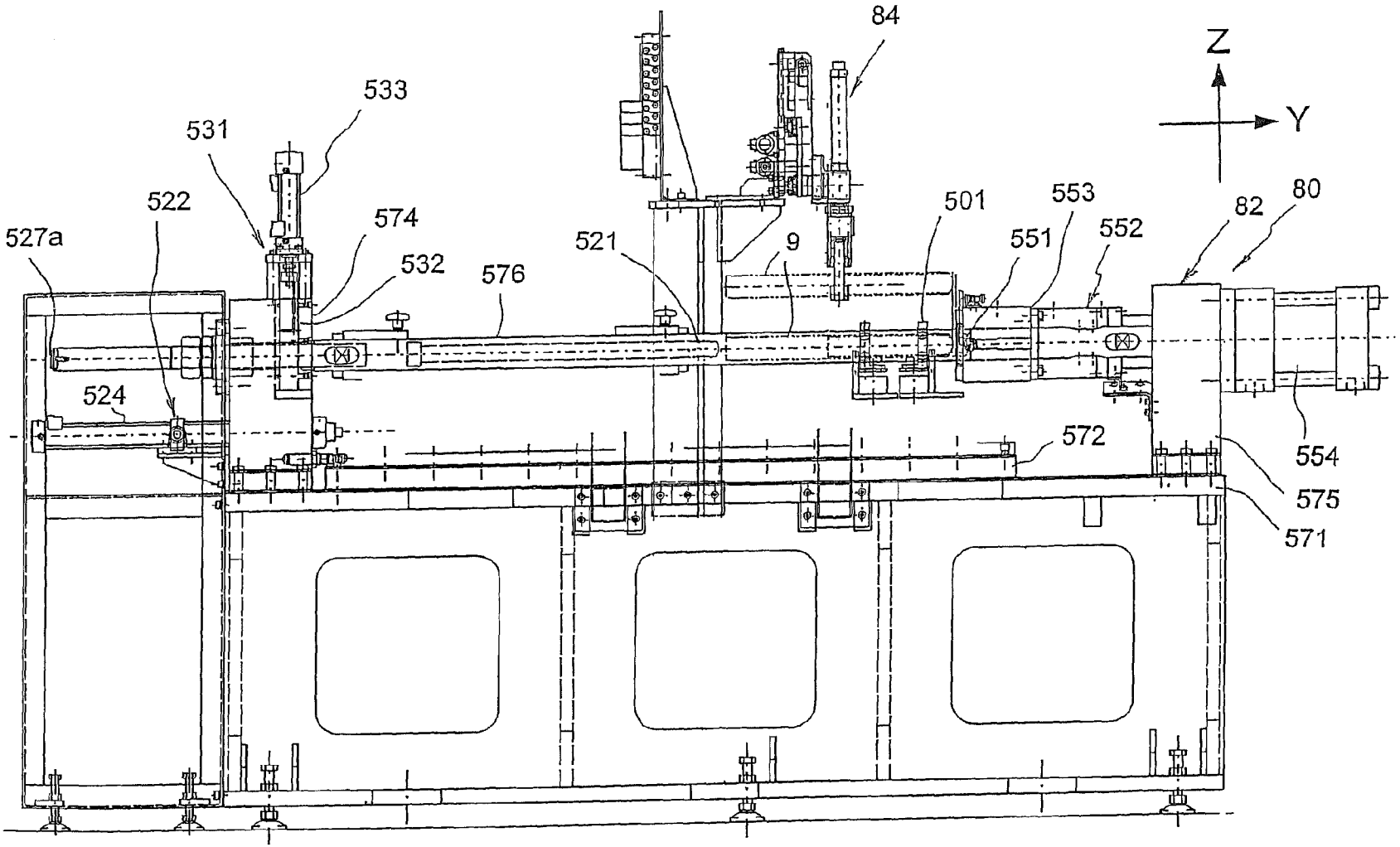
FIG. 1 is a side view of a press-molding device, illustrating an embodiment of this invention.

As shown in FIG. 1, a conveyance device 84 is provided on an upper portion of the press-molding device 80. The conveyance device 84 conveys the work piece 9 to the introduction table 81, press-molding machine 82 and discharge table 83 in sequence.

The press-molding machine 82 press-molds the bottom portion of the work piece 9 between an inner die 521 inserted into an inside end of the work piece 9, and an outer die 551 disposed on the outside of the work piece 9.

The press-molding device 80 comprises a core adjusting chuck mechanism 501 which grips the work piece 9 so that the work piece 9 can move in the Y axis direction, an inner die moving mechanism 522 which moves the inner die 521 in the Y axis direction via an air cylinder 524 so that the inner die 521 is inserted into the inside end of the work piece 9, a stopper mechanism 531 which supports the inner die 521 in a processing position by restricting movement of the inner die 521, and an outer die moving mechanism 552 which moves the outer die 551 in the Y axis direction via a hydraulic cylinder 554 such that the bottom portion of the work piece 9 is press-molded between the inner die 521 and the outer die 551. The inner die 521 and outer die 551 are disposed coaxially with the work piece 9.

The inner die moving mechanism 522 comprises two guide rails 572 provided on a pedestal 571 so as to extend in the Y axis direction, a sliding table 523 which is supported movably via the guide rails 572, and an air cylinder 524 which moves the sliding table 523. The inner die 521 is connected to the sliding table 523.

The inner die 521, which takes the form of a rod, is connected to a front portion of the sliding table 523 at a base end portion thereof, penetrates a guide table 525 from a midway point thereof, and moves coaxially with the work piece 9.

The guide table 525 is supported so as to be capable of moving in the Y axis direction via the guide rails 572. The position of the guide table 525 relative to the pedestal 571 can be varied in accordance with variation in the length of the work piece 9 and so on via an adjustment mechanism 526.

Figure 2:
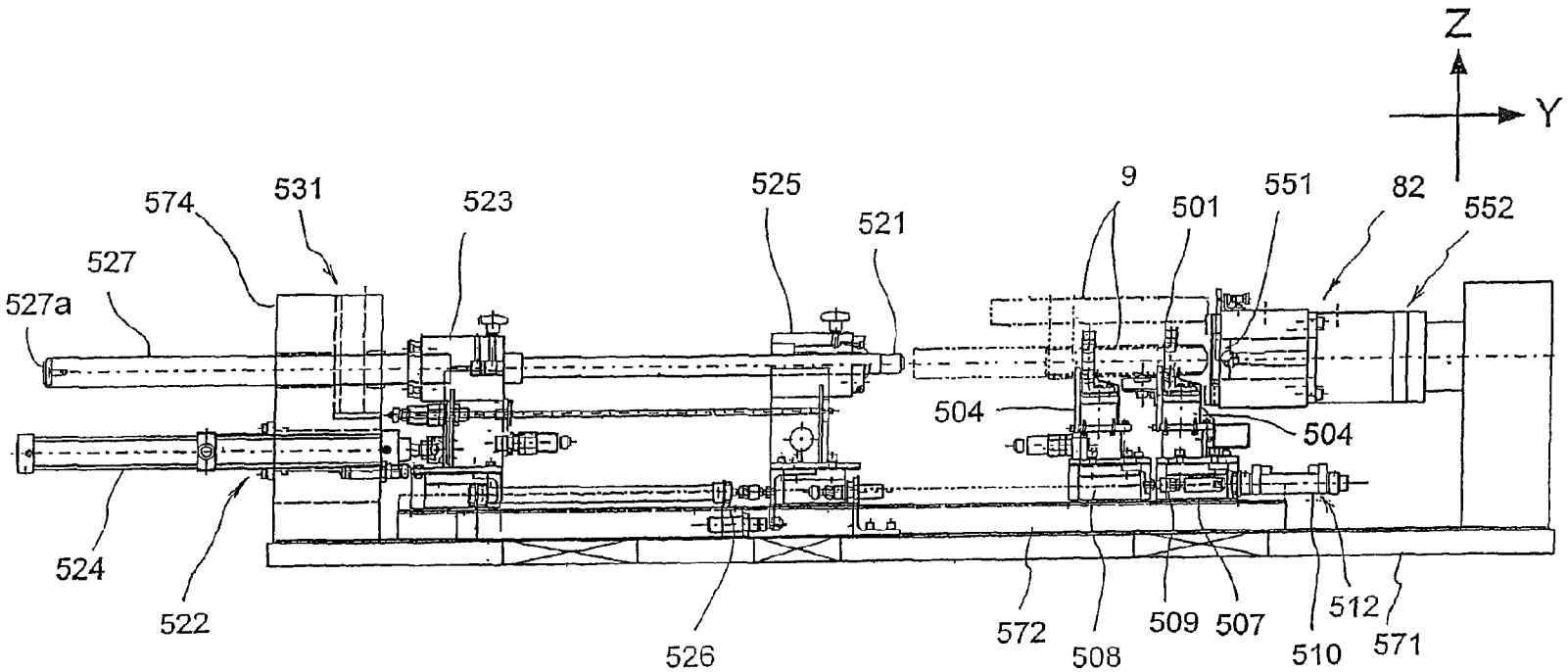
FIG. 2 is a sectional view of the press-molding device.

As shown in FIG. 2, when the air cylinder 524 contracts, the sliding table 523 retreats in the Y axis direction together with the inner die 521 such that the inner die 521 does not interfere with the work piece 9 introduced into and discharged from the core adjusting chuck mechanism 501.

When the air cylinder 524 expands, the sliding table 523 advances in the Y axis direction together with the inner die 521 such that the inner die 521 is inserted into the inside end of the work piece 9 gripped by the core adjusting chuck mechanism 501.

A positioning shaft 527 is connected to a rear portion of the sliding table 523. In other words, the inner die 521 and the positioning shaft 527 project respectively from the front and rear end portions of the pedestal 571. The positioning shaft 527 extends coaxially with the inner die 521, and a tip end portion 527*a* thereof is supported by the stopper mechanism 531.

Figure 4:
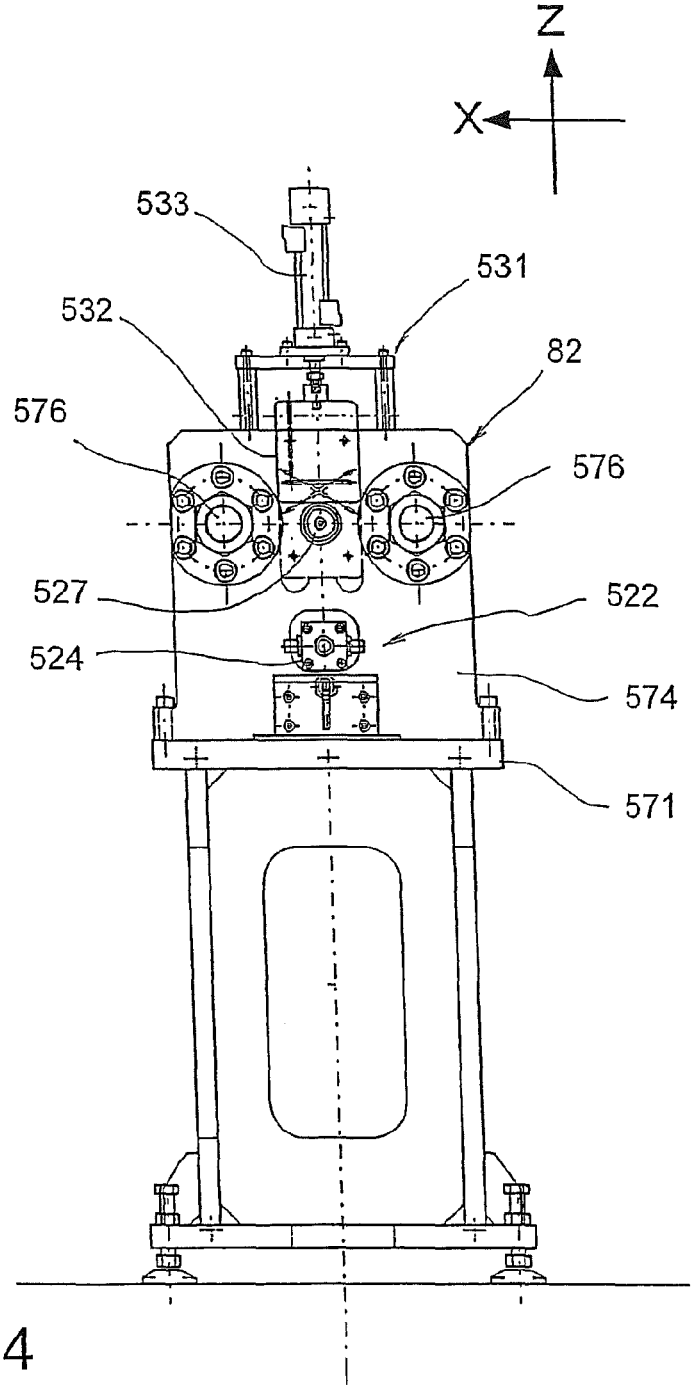
FIG. 4 is a front view of the press-molding device.

As shown in FIG. 4, a support table 574 stands upright on the rear end portion of the pedestal 571. The stopper mechanism 531 is provided on the support table 574. The air cylinder 524 and the positioning shaft 527 are provided so as to penetrate the support table 574.

The stopper mechanism 531 comprises a stopper plate 532 inserted into the path that is penetrated by the positioning shaft 527, and an air cylinder 533 for driving the stopper plate 532. The stopper plate 532 is supported elevatably relative to the support table 574.

When the air cylinder 533 contracts, the stopper plate 532 is held in an elevated position relative to the support table 574, and the positioning shaft 527 moves freely below the stopper plate 532.

When the air cylinder 533 expands, the stopper plate 532 descends relative to the support table 574, and the rear tip end portion 527*a* of the positioning shaft 527 contacts the stopper plate 532. As a result, the stopper mechanism 531 restricts movement of the inner die 521 such that the inner die 521 is supported in a processing position.

The outer die moving mechanism 552 comprises a guide mechanism 553 which supports the outer die 551 movably in the Y axis direction, and a hydraulic cylinder 554 which drives the outer die 551.

A support table 575 stands upright on a front end portion of the pedestal 571. The hydraulic cylinder 554 and the guide mechanism 553 are connected respectively to the front and rear portions of the support table 575.

The front and rear support tables 574, 575 are connected to each other via two beams 576, thereby securing enough rigidity to prevent the support tables 574, 575 from collapsing in the front-rear direction.

Figure 5:
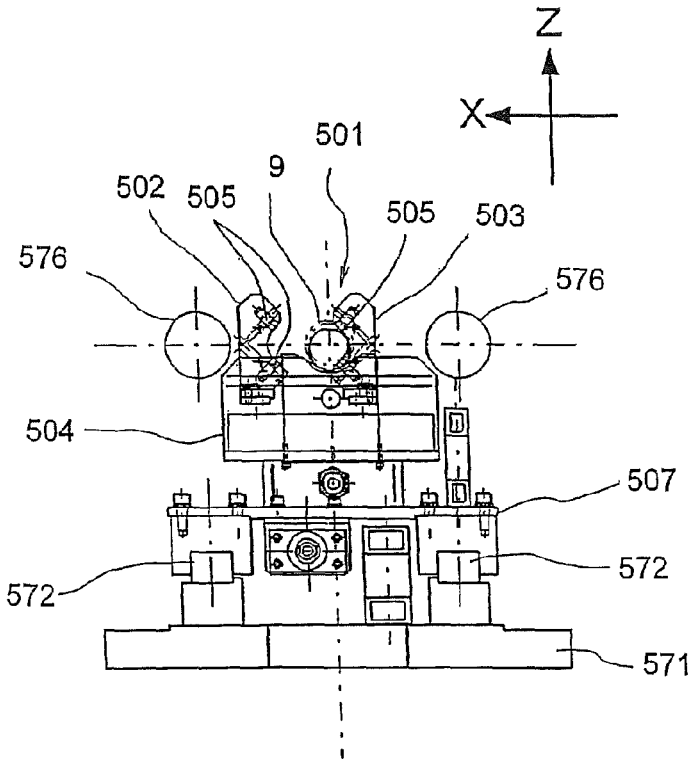

As shown in FIG. 5, the core adjusting chuck mechanism 501 comprises left and right chucks 502, 503 provided as a front and rear pair, and by opening and closing the chucks 502, 503, the outer peripheral surface of the work piece 9 is gripped.

The right chuck 502 is fixed to a chuck table 504. The left chuck 503 is supported so as to be capable of moving in the X axis direction relative to the chuck table 504. The left chuck 503 is driven by an air cylinder, not shown in the figure, and thus the left and right chucks 502, 503 are opened and closed.

The left and right chucks 502, 503 are each provided with a pair of rollers 505. Each roller 505 is supported so as to be capable of rotating about an orthogonal axis to the Y axis relative to the left and right chucks 502, 503. The work piece 9 that is gripped by the left and right chucks 502, 503 via the four rollers 505 can move in the Y axis direction in rotational contact with each roller 505.

A chuck position switching mechanism 512 is provided for switching the position of the core adjusting chuck mechanism 501 in the Y axis direction. The chuck position switching mechanism 512 comprises front and rear sliding tables 507, 508 that are supported movably in the Y axis direction via left and right guide rails 572, and an air cylinder 510 that drives the front and rear sliding tables 507, 508 to two positions. The chuck tables 504 provided as a front and rear pair are fixed to the front and rear sliding tables 507, 508, respectively.

The front and rear sliding tables 507, 508 are connected such that the Y axis direction gap therebetween can be adjusted via an adjustment mechanism 509. Thus, the gap between the front and rear chucks 502, 503 can be adjusted easily in accordance with variation in the length of the work piece 9 and so on.

A controller not shown in the figure operates the conveyance device 84, the core adjusting chuck mechanism 501, the inner die moving mechanism 522, the stopper mechanism 531, and the outer die moving mechanism 552 in a predetermined sequence in accordance with signals from position sensors 91 to 97 and so on, and as a result, the work piece 9 is press-molded automatically.

The press-molding device 80 operates automatically, and therefore there is no need for an operator 79 to operate the press-molding device 80 during a normal operation.

The work piece 9 is press-molded by performing each of the processes to be described below in sequence using the press-molding device 80 constituted as described above.

Figure 6A:
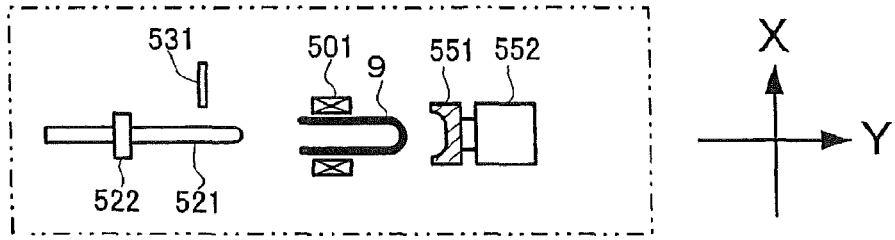
FIGS. 6A to 6F are views showing processes for press-molding a work piece.

As shown in FIG. 6A, the work piece 9 conveyed by the conveyance device 84 is gripped by the core adjusting chuck mechanism 501.

Figure 6B:
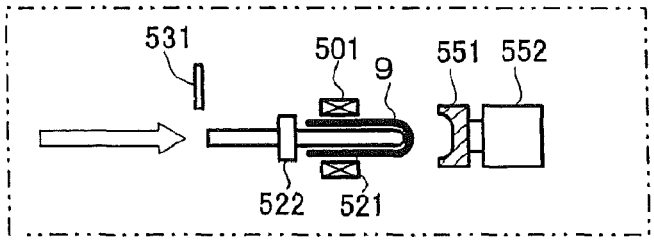

As shown in FIG. 6B, the inner die moving mechanism 522 moves the inner die 521 forward to insert the inner die 521 into the inside end of the work piece 9.

Figure 6C:
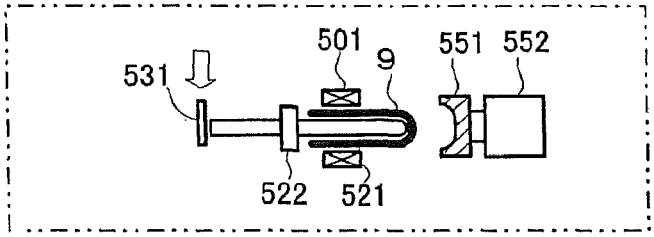

As shown in FIG. 6C, the stopper mechanism 531 lowers the stopper plate 532.

Figure 6D:
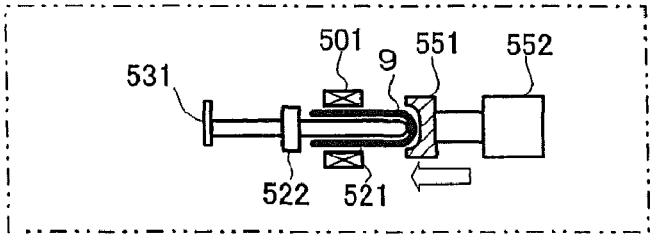

As shown in FIG. 6D, the hydraulic cylinder 554 of the outer die moving mechanism 552 moves the outer die 551 rearward such that the bottom portion of the work piece 9 is press-molded between the outer die 551 and the inner die 521.

Figure 6E:
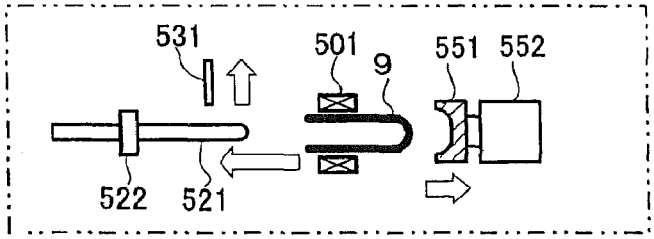

As shown in FIG. 6E, the hydraulic cylinder 554 of the outer die moving mechanism 552 moves the outer die 551 forward. At the same time, the stopper mechanism 531 raises the stopper plate 532, whereupon the inner die moving mechanism 522 moves the inner die 521 rearward to remove the inner die 521 from the work piece 9.

Figure 6F:
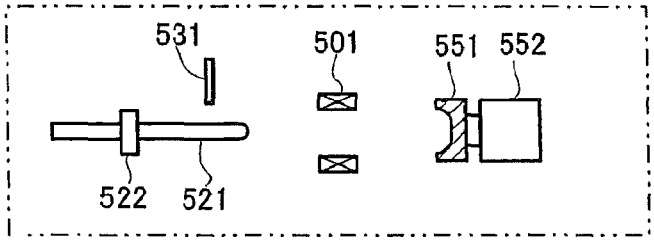

As shown in FIG. 6F, the core adjusting chuck mechanism 501 is opened, whereupon the press-molded work piece 9 is removed by the conveyance device 84.

Returning to FIG. 6A, the next work piece 9 conveyed by the conveyance device 84 is gripped by the core adjusting chuck mechanism 501. Then, by repeating each of the processes described above, work pieces 9 are press-molded one by one.

The actions of the constitution described above will now be described.

During press-molding, in which the work piece 9 is compressed between the outer die 551 and the inner die 521, the core adjusting chuck mechanism 501 permits movement of the work piece 9 in the Y axis direction via the rollers 505, and therefore, when the inner die moving mechanism 522 moves the inner die 521 forward such that the inner die 521 is inserted into the inside end of the work piece 9, the core adjusting chuck mechanism 501 can grip the outer peripheral surface of the work piece 9, and the inner die 521 can be prevented from impinging on the inner peripheral surface of the work piece 9 and causing damage thereto.

When the hydraulic cylinder 554 of the outer die moving mechanism 552 moves the outer die 551 in the Y axis direction to press the work piece 9, the work piece 9 retreats slightly while the outer peripheral surface thereof contacts the rollers 505 rotationally. Thus, the rear tip end portion 527*a* of the positioning shaft 527 contacts the stopper plate 532, and as a result, the stopper mechanism 531 restricts movement of the inner die 521 such that the inner die 521 is held in the processing position. Hence, when the outer die 551 pushes the work piece 9 further, the work piece 9 is compressed smoothly between the outer die 551 and the inner die 521, and as a result, the work piece 9 is press-molded into a predetermined shape.

The core adjusting chuck mechanism 501 grips the work piece 9 via the plurality of rollers 505 that contact the outer peripheral surface of the work piece 9 rotationally, and therefore core adjusting precision can be secured in relation to the work piece 9, and the work piece 9 can be moved smoothly in the Y axis direction.

A stroke in which the hydraulic cylinder 554 of the outer die moving mechanism 552 moves the outer die 551 is much smaller than a stroke in which the air cylinder 524 of the inner die moving mechanism 522 moves the inner die 521, and therefore the hydraulic cylinder 554 can be reduced in size and power.

The inner die moving mechanism 522 inserts the inner die 521 into the inside end of the work piece 9 by means of the expansion and contraction operations of the air cylinder 524, and therefore the inner die 521 can be moved quickly, enabling a reduction in the tact time for press-molding a single work piece 9 and an improvement in production efficiency.

The inner die moving mechanism 522 comprises the sliding table 523 that moves in the Y axis direction, the inner die 521 projecting from the front portion of the sliding table 523 and the positioning shaft 527 projecting from the rear portion of the sliding table 523, and the stopper mechanism 531 inserts the stopper plate 532 into the path penetrated by the positioning shaft 527. Thus, the inner die 521 can be supported securely in the processing position.

The chuck position switching mechanism 512 is capable of switching the position of the core adjusting chuck mechanism 501 in the Y axis direction in accordance with variation in the length of the work piece 9 and so on.

INDUSTRIAL APPLICABILITY

As described above, the press-molding method and press-molding device according to this invention may be used to press-mold a bottom portion of a work piece having a closed-end shape between an inner die and an outer die.

The invention claimed is:

1. A press-molding method for press-molding a bottom portion of a work piece having a closed-end shape between an inner die inserted into an inside end of the work piece and an outer die disposed on an outside of the work piece, comprising:

gripping the work piece via a core adjusting chuck mechanism so that the work piece can move in an axial direction thereof;

moving the inner die in the axial direction via an inner die moving mechanism so that the inner die is inserted into the inside end of the work piece;

restricting movement of the inner die via a stopper mechanism so that the inner die is supported in a processing position; and moving the outer die in the axial direction of the work piece via an outer die moving mechanism so that the bottom portion of the work piece is press-molded between the outer die and the inner die in a state where the core adjusting chuck mechanism grips the work piece so that the work piece can move in an axial direction thereof and the stopper mechanism restricts movement of the inner die so that the inner die is supported in a processing position.

2. A press-molding device for press-molding a bottom portion of a work piece having a closed-end shape between an inner die inserted into an inside end of the work piece and an outer die disposed on an outside of the work piece, comprising:

a core adjusting chuck mechanism that grips the work piece so that the work piece can move in an axial direction thereof in a state where the bottom portion of the work piece is press-molded between the inner die and the outer die;

an inner die moving mechanism that inserts the inner die into the inside end of the work piece by moving the inner die in the axial direction;

a stopper mechanism that supports the inner die in a processing position by restricting movement of the inner die in a state where the bottom portion of the work piece is press-molded between the inner die and the outer die; and an outer die moving mechanism that press-molds the bottom portion of the work piece between the outer die and the inner die by moving the outer die in the axial direction.

3. The press-molding device as defined in claim 2, wherein the core adjusting chuck mechanism grips the work piece via a plurality of rollers that contact an outer peripheral surface of the work piece rotationally.

4. The press-molding device as defined in claim 2, wherein the inner die moving mechanism comprises a sliding table that moves in the axial direction of the work piece, the inner die projecting from a front portion of the sliding table and a positioning shaft projecting from a rear portion of the sliding table, and the stopper mechanism inserts a stopper plate into a path penetrated by the positioning shaft.

5. The press-molding device as defined in claim 2, further comprising a chuck position switching mechanism that switches a position of the core adjusting chuck mechanism in the axial direction of the work piece.

* * * * *